US005876240A

United States Patent [19]

Derstine et al.

[11] Patent Number: 5,876,240

[45] Date of Patent: Mar. 2, 1999

[54] STACKED ELECTRICAL CONNECTOR WITH VISUAL INDICATORS

[75] Inventors: Michael Paul Derstine; Albert David Willette, both of Winston-Salem; Randy Gray Simmons, Lewisville, all of N.C.

[73] Assignee: The Whitaker Corp, Wilmington, Del.

[21] Appl. No.: 829,919

[22] Filed: Apr. 1, 1997

[51] Int. Cl.[6] ..... H01R 3/00

[52] U.S. Cl. ..... 439/490; 439/79; 340/815.47

[58] Field of Search ..... 439/541.5, 490; 340/815.47, 815.45, 815.42, 815.49, 815.5; 362/95

[56] References Cited

U.S. PATENT DOCUMENTS

| | | | |
|---|---|---|---|
| 4,379,606 | 4/1983 | Clark et al. | 439/76.1 |
| 4,386,818 | 6/1983 | Millhimes et al. | 439/490 |
| 4,397,513 | 8/1983 | Clark et al. | 439/490 |
| 4,699,443 | 10/1987 | Goodrich et al. | 439/188 |
| 4,726,638 | 2/1988 | Farrar et al. | 439/620 |
| 4,978,317 | 12/1990 | Pocrass | 439/490 |
| 5,069,641 | 12/1991 | Sakamoto et al. | 439/620 |
| 5,178,563 | 1/1993 | Reed | 439/676 |
| 5,277,625 | 1/1994 | Ianella | 439/620 |
| 5,403,195 | 4/1995 | Thrush et al. | 439/69 |
| 5,480,319 | 1/1996 | Vlakancic | 439/490 |
| 5,587,884 | 12/1996 | Raman | 361/728 |
| 5,601,451 | 2/1997 | Driones et al. | 439/490 |
| 5,613,873 | 3/1997 | Bell, Jr. | 439/490 |
| 5,637,020 | 6/1997 | Ito | 439/699 |
| 5,700,157 | 12/1997 | Chung | 439/490 |
| 5,741,152 | 4/1998 | Boutros | 439/490 |

*Primary Examiner*—Neil Abrams
*Assistant Examiner*—Barry M. L. Standig
*Attorney, Agent, or Firm*—Robert Kapalka

[57] ABSTRACT

A stacked electrical connector 2 including right angle RJ-45 modular jacks 4 positioned in columns also includes LED's 38 positioned on the front mating face 18 of the connector 2. Internal passages 28 extend from the mating face 18 of the jack housing 18 and intersect channels 34 extending to the bottom pcb mounting face 22 where the connector 2 and jacks 4 are soldered to a printed circuit board. LED leads 42 are located in the passages 28 and contacts 44 are located in channels 34. Insulation displacement slots 48 at the top of the contacts 44 terminate the leads 42. The termination points are staggered and the leads 42 in a column are of different lengths so that contacts 44 of different lengths can engage corresponding leads 42. LED's 38 can thus be positioned beside mating openings 20 on the front of the connector 2 to provide status indications.

20 Claims, 5 Drawing Sheets

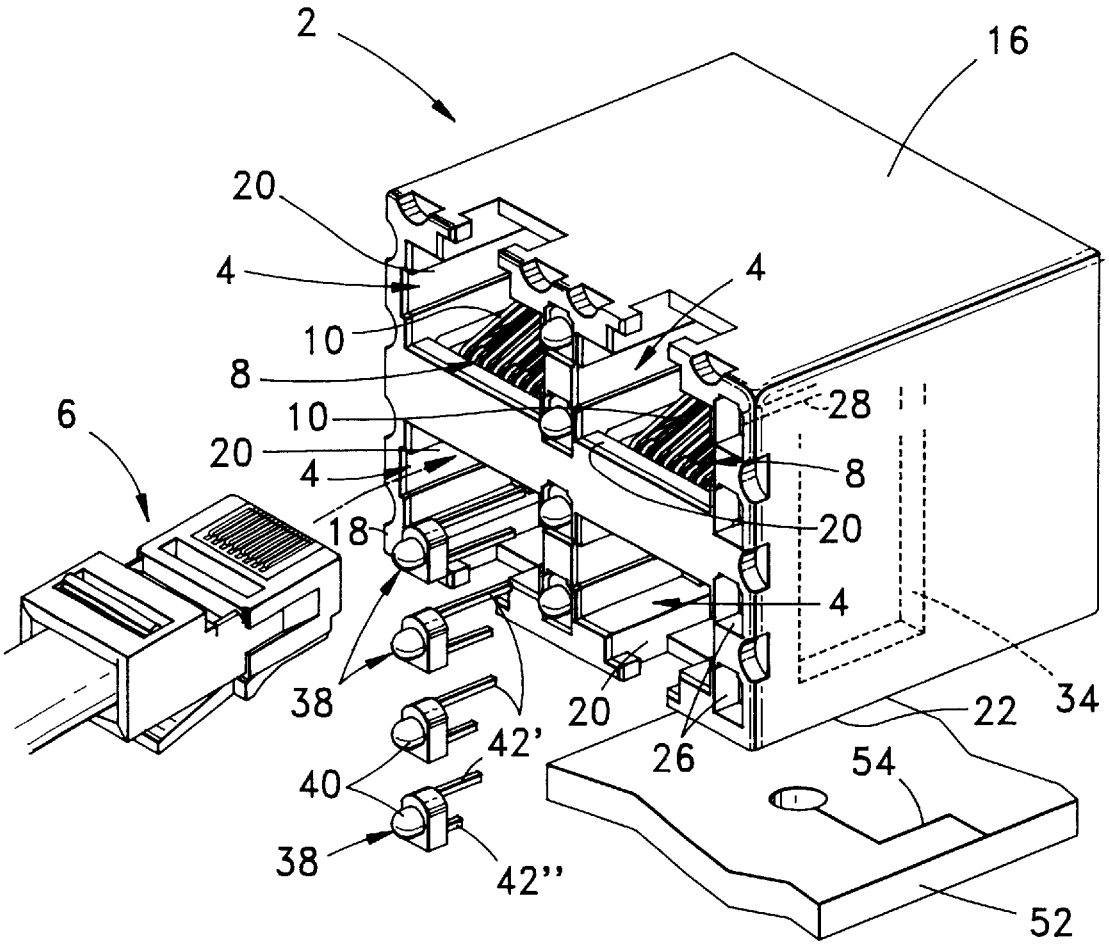
Fig. 1
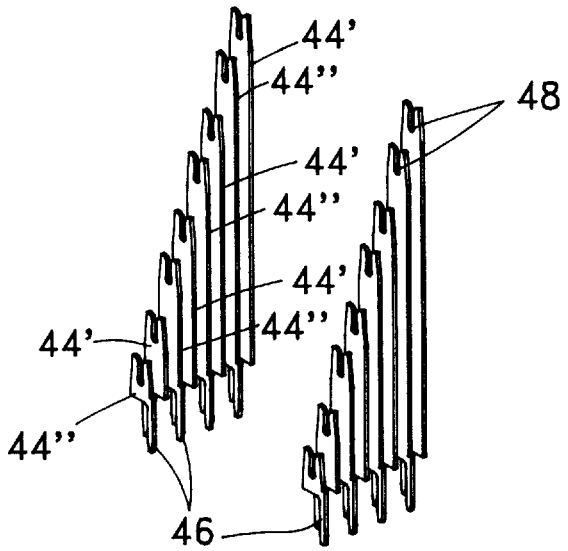

STACKED ELECTRICAL CONNECTOR WITH VISUAL INDICATORS

FIELD OF THE INVENTION

This invention is related to electrical connectors and especially to electrical connectors used to connect cables to printed circuit board, such as serial devices that are connected to computers, computer networking devices, or peripherals. More specifically, this invention is related to modular jacks and to the use of LED's to provide a visual indication of the communication status for the circuit connected by the modular jack.

BACKGROUND OF THE INVENTION

There are a number of instances in which it may be desirable to have a simple indication of the status of an electrical connection to a computer, a computer peripheral, computer network or to instrumentation, telecommunications, inspection or a similar device or network. Indicators of this type are especially useful for products such as networking hubs, switches and routers. A simple visual indication provided by an LED located adjacent to an input/output connector is often desirable. For example, an indication that a device, or its input cable, has been properly wired or connected is helpful to insure proper installation. A flashing LED is often useful as a means to show that communications is occurring on that circuit. This visual indicator can help a user diagnose a problem without requiring the assistance of a specialist. For example, the absence of a flashing indicator on a modem will show that communication has not been properly established or that a connection has been lost.

One traditional approach to insuring that a device, a cable or a network has been properly wired, connected or assembled is the use of a standalone testing device. Elimination of this separate testing device by incorporating an LED or other indicator, visual or otherwise, in the component itself has advantages, not only during installation, but during operation of the device. However. the addition of LED's or other indicators to an already crowded device does pose space problems. One approach that has been suggested is to add the LED on the front or mating face of the electrical connector to save printed circuit board real estate.

Several patents show suggestions for incorporating LED's on the mating face of a modular jack, and especially on the front of an RJ-45 eight position modular jack. U.S. Pat. No. 4,978,317 shows an RJ-45 jack with two light emitting diodes mounted on the mating face of the jack. In this patent the LED's are mounted along the side of the jack mating opening opposite from which the mating ends of the terminals are attached. To connect the LED's to a printed circuit board, mounted along an opposite surface of this single position jack housing, the LED leads must extend around two sides of the jack and protrude from the printed circuit board mounting face of the jack. These LED leads appear to require a length that is greater than the length of leads typically employed for many through hole LED's. For multiple position or stacked jacks, the LED lead length would have to be even greater for a device constructed in this manner.

U.S. Pat. No. 5,601,451 shows another approach in which the LED's are mounted adjacent to the printed circuit board. Clearly however, this approach is limited to a single position modular jack and does not offer a solution to providing multiple LED's for each of multiple jacks mounted in a stacked configuration or included in a single housing mounted on the edge of a printed circuit board.

Another approach is the use of surface mount LED's located below a printed circuit board housing, but that approach requires that both surface mount components and through hole components be used on the same printed circuit board, if standard through hole modular jacks are to be employed. This approach can cause problems or can require additional care during the soldering operation to insure that satisfactory through hole and surface mount solder joints are established on the same board. Through hole jacks mounted above surface mount LED's can leave the surface mount joints unexposed, thus leading to unreliable solder joints. Dual processing for the through hole jack leads and the surface mount LED's would probably be necessary.

Still another approach that has been suggested is the use of LED's mounted on upstanding flexible films that are mounted on a printed circuit board in front of the connector or jack. This requires the addition of a separate piece and requires the film be positioned in registry with the mating openings in a printed circuit board. Separately mounting component in this manner is further complicated when stacked connectors, employing jacks stacked one above the other, are employed.

SUMMARY OF THE INVENTION

The electrical connector of the instant invention includes an indicator, such as a light emitting diode on the front or mating face of the electrical connector. In this invention multiple LED's can be placed on the front of the connector Each LED is positioned in a cavity on the connector, and the leads from the LED body extend into housing passages extending from the front of the connector. Each of these passages intersects a channel and contact terminals located in the channel establish an electrical connection at the intersection of rearwardly extending passages and upwardly extending channels.

This invention is especially useful for stacked electrical connectors in which individual connector mating openings are located one above the other in a single nonconductive connector housing. LED's are located beside each opening, and multiple LED's are positioned one above another in a column. In the preferred embodiment, two LED's are located beside each connector mating opening. One LED can indicate that the circuit is properly connected and the other LED can indicate when communication is taking place over the circuit.

In this stacked configuration, the length of the LED leads varies progressively with the longest leads being located at the top of the column for the preferred embodiment. The contacts that electrically connect the LED leads to an external component, such as a printed circuit board, also vary in length, with the longest contacts at the rear connected to the longest leads at the top. The electrical connections formed at the intersection of the leads and contacts are then staggered from back to front with the contacts being positioned one behind another in a row.

The preferred embodiment of this invention is a modular jack with the LED indicators being located beside the modular jack openings and with the LED leads extending through passages beside the modular jack terminals. For right angle printed circuit board mounted modular jacks, the contacts are inserted into channel on the lower surface of the modular jack. These contacts can be partially inserted prior to insertion of the LED leads into rearwardly extending passages. After the LED leads are inserted, the contacts are pushed into their fully inserted position where they intersect and electrically terminate the LED leads. In the preferred embodiment, the contacts include insulation displacement slots at the top, and these slots receive and engage the LED leads to form a gas tight electrical termination.

BRIEF DESCRIPTION OF THE INVENTION

FIG. 1 is an exploded perspective view of a stacked connector assembly including four RJ-45 modular jacks with two light emitting diodes for each modular jack positioned as status indicators on the front of the modular jack.

Figure 2:
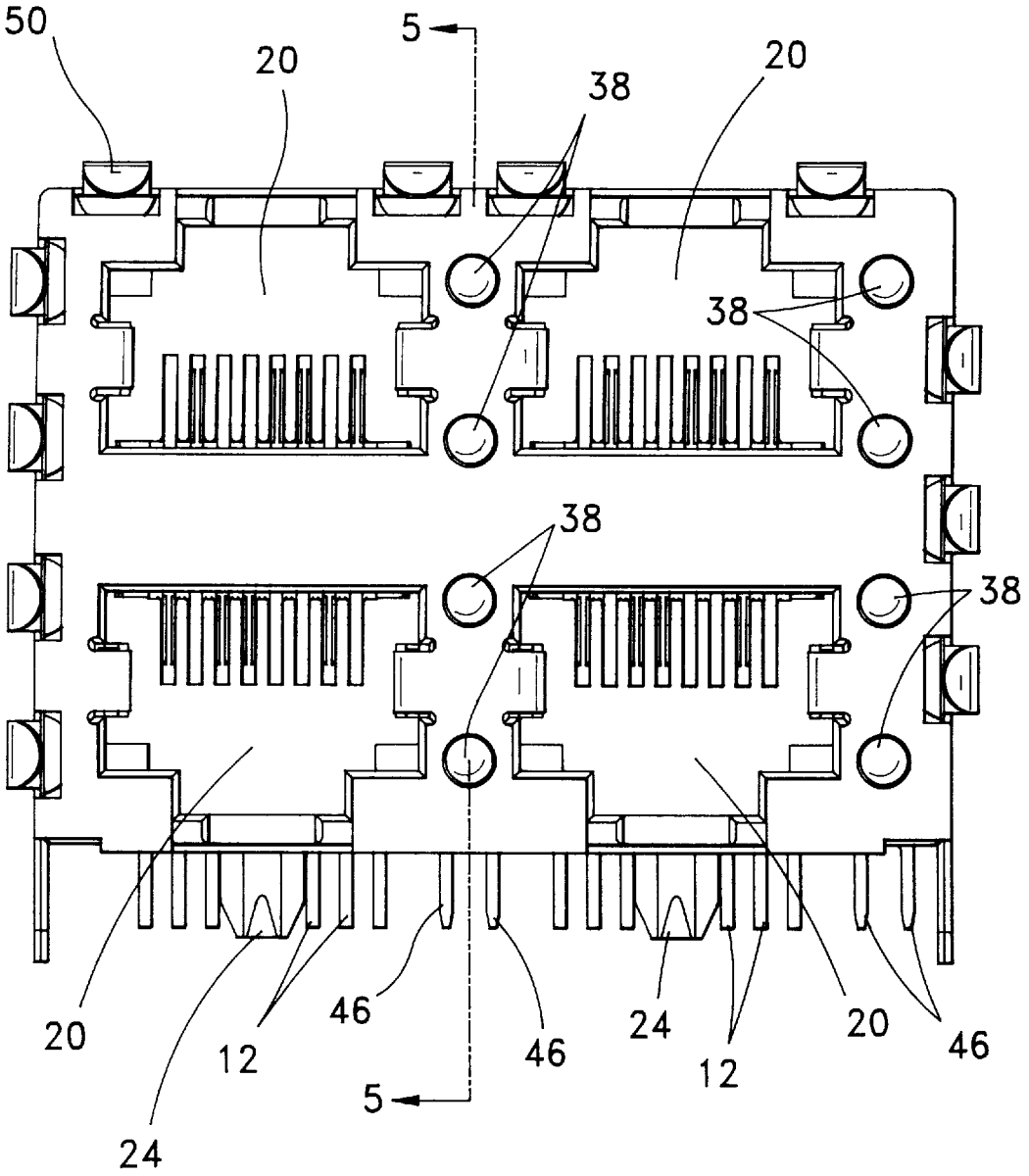
FIG. 2 is a front view of the stacked connector assembly shown in FIG. 1.
Figure 5:
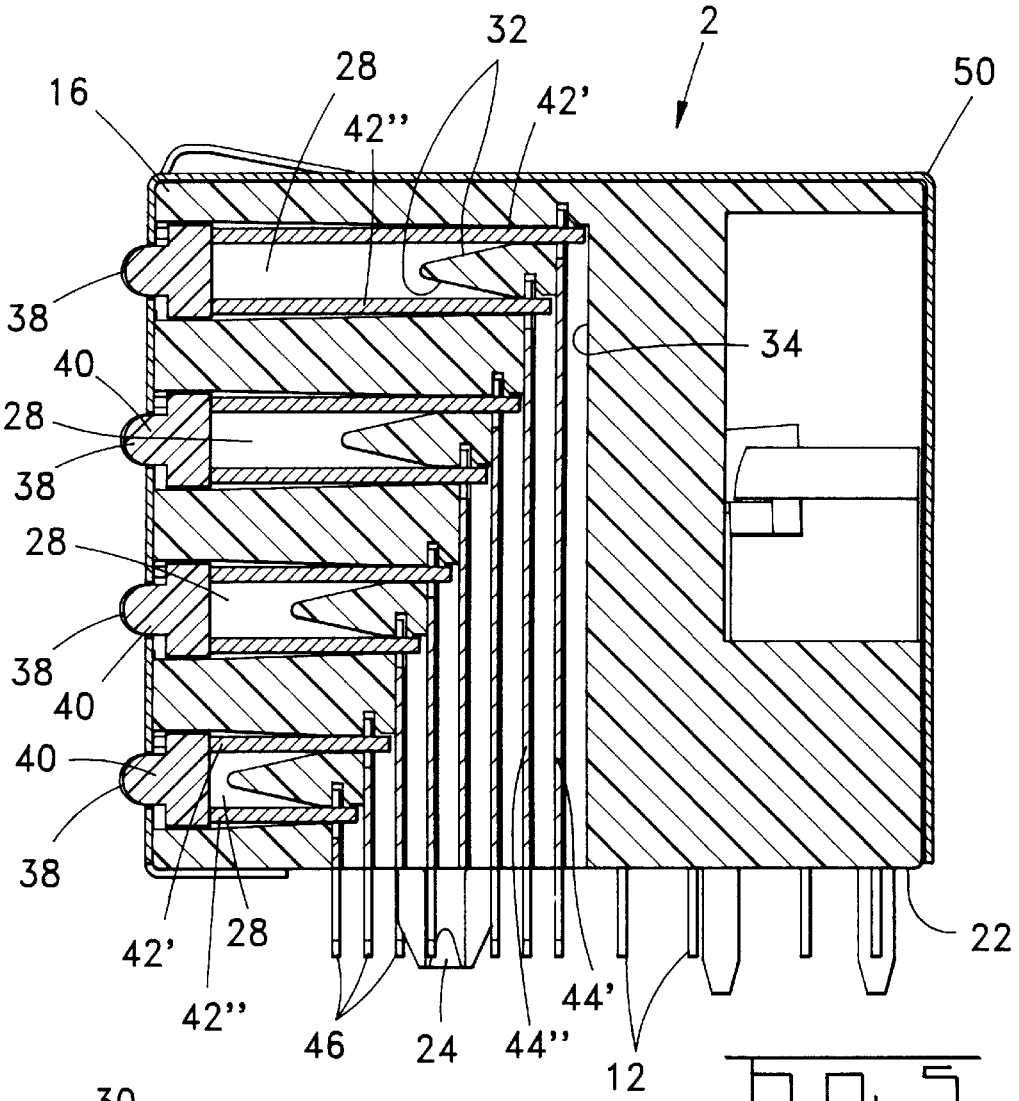

FIG. 5 is a section view taken along section lines 5—5 in FIG. 2. This section shows all of the LED leads in corresponding passages that would extend into a single channel for one column of four LED's. The eight insulation displacement contacts at the intersection or termination to the LED leads are also shown.

Figure 6:
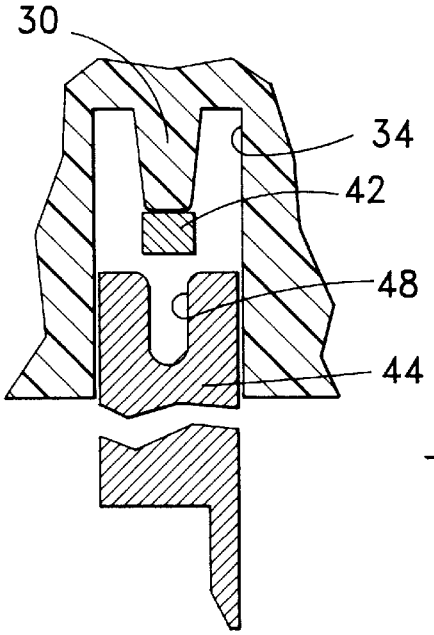

FIG. 6 is a detail view of the position of the LED leads and the LED lead support. In this figure the insulation displacement contact is shown in the preloaded position from which the contact will then be pushed up to establish an insulation displacement contact with the supported solder lead.

DETAILED DESCRIPTION OF THE PREFERRED EMBODIMENT

Although this invention can be employed with single modular jacks or other printed circuit mounted electrical connectors, it has additional advantages when employed with a stacked electrical connector, such as the four position stacked RJ-45 modular jack 2 shown in FIG. 1. It could also be used with other jacks, such as an RJ-11. Four individual modular jacks 4 are included in this single connector assembly 2. Upper and lower jacks 4 are positioned side by side in two columns In the preferred embodiment, each individual jack 4 is an eight position RJ-45 jacks of the type used for serial communication. A standard RJ-45 plug or male connector 6 is the compatible mating connector for each of these individual jacks 4.

Figure 3:
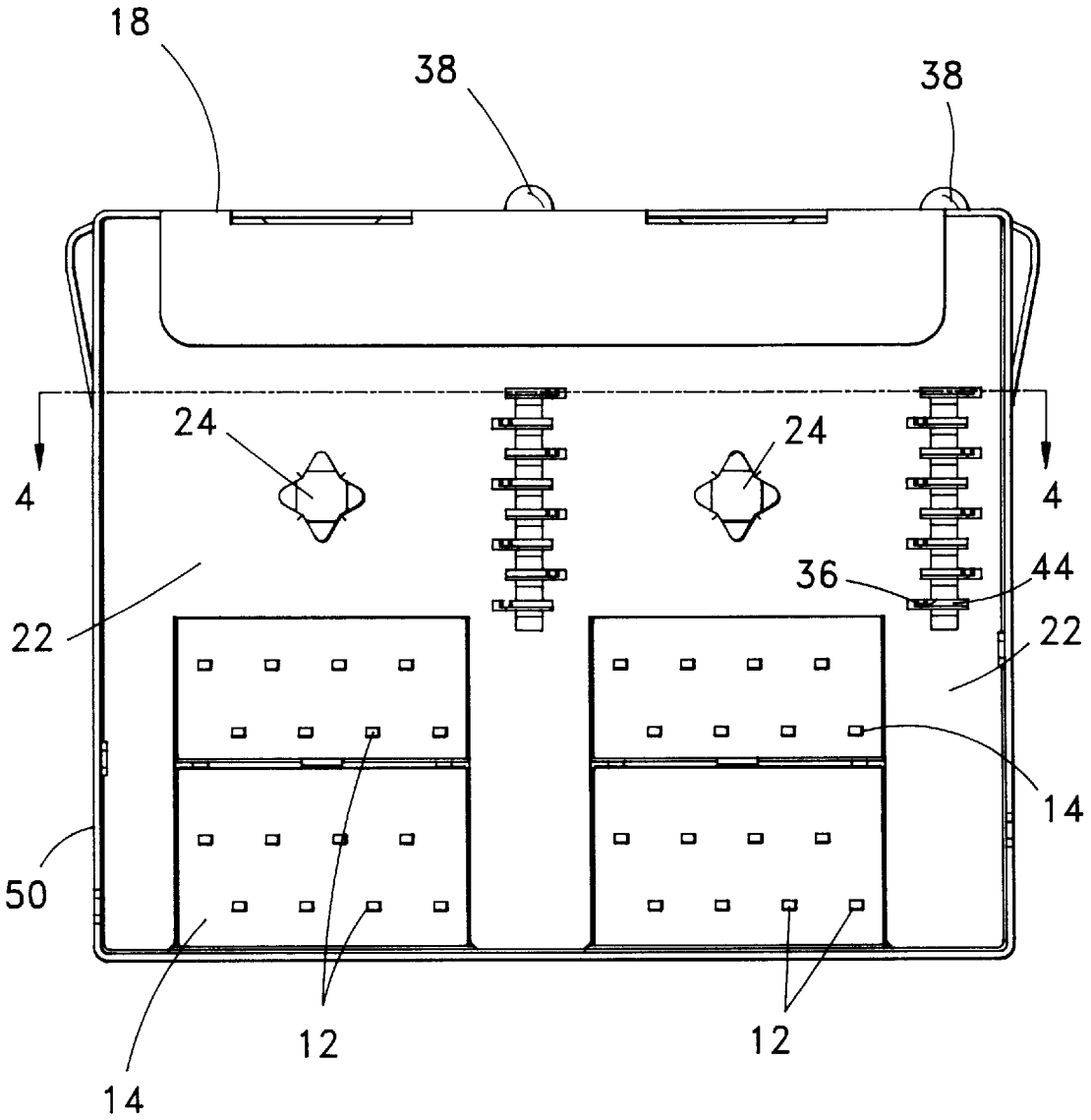
FIG. 3 is a bottom view of the stacked connector assembly showing the position of the terminal leads for the modular jacks and the LED contacts and solder tails extending from the LED contacts and showing the pattern of through hole solder leads or tails for connecting the connector assembly to a printed circuit board.
Figure 4:
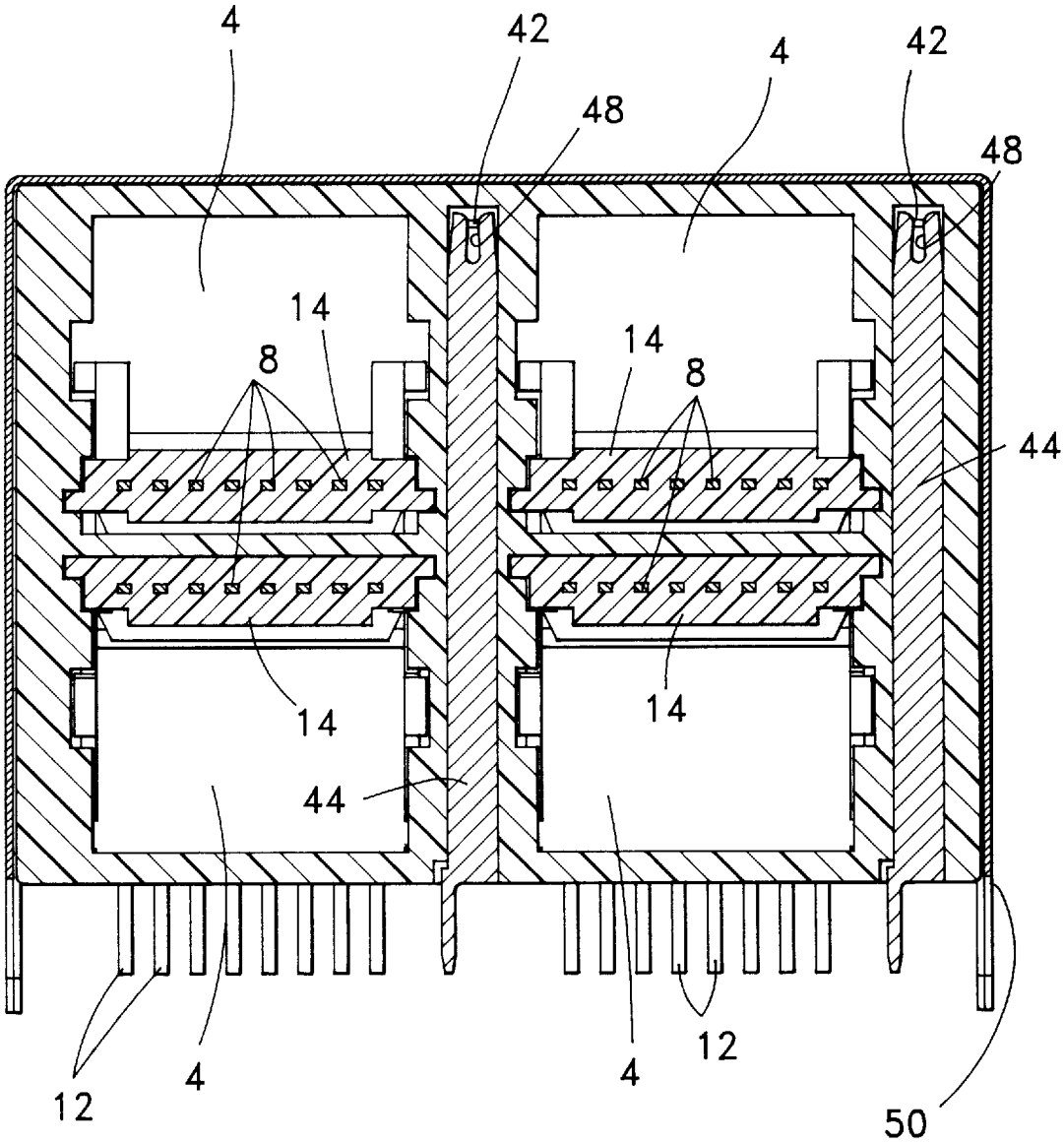
FIG. 4 is a section view taken along section lines 4—4 in FIG. 3. This section is taken through the longest printed circuit board contacts on each side of the stacked jacks.

Each of these modular jacks 4 include eight terminals 8 of conventional construction. Each terminal 4 has a mating end 10 which forms a resilient spring for establishing electrical contact with conventional blades when mated with plug 6. In the representative embodiment depicted herein, each of the terminals 12 is insert molded in a plastic body 14 as shown in FIGS. 3 and 4, and this body is in turn positioned in the integral nonconductive housing 16 with the mating ends 10 of the aligned terminals of each jack 4 positioned within a mating opening 20 configured to receive mating plug 6. The four mating openings 20 are located on a laterally oriented mating face 18 in this right angle jack configuration. The stacked modular jack 2 is intended to be mounted on the edge of a printed circuit board with a bottom or housing mounting face 22 extending perpendicular to the upright mating face 18. The mating face 18 can then be positioned in a cutout in a vertical exterior wall of the device in which the stacked modular jack 2 is to be used.

The stacked modular jack 2, as described thusfar, is conventional in construction. This jack 2 however includes an array of visual indicators in the form of LED's 38 mounted on the front or mating face 18. In this embodiment two LED's 38 are located beside each mating opening 20 and therefore beside each individual jack 4. Two LED's 38 are mounted beside each individual jack 4. Four LED's 38 are then positioned in two columns, each column being located on one side of the two stacked jacks. Each LED 38 is mounted in a mounting cavity 26 extending inwardly from the mating face 18. As best seen in FIG. 5, internal passages 28 extend from each LED mounting cavity 26 and penetrate the housing perpendicular to the mating face 18 and parallel to the mounting face 22. Each internal passage 28 intersects a channel 34 that extends from the housing mounting face 22 generally parallel to the mating face 18. Channel 34 therefore extends at substantially right angles to the intersecting passages 28 in this right angle stacked modular jack 2.

Each internal passage 28 has a cross sectional area sufficient to receive the two leads 42 extending from the body or lens of LED 38. These passages are formed by core pins when the nonconductive housing 16 is molded, and in the preferred embodiment, each passage 28 has a rectangular cross section. Since four LED's are positioned in one column on the mating face 18, four separate individual passages are formed, one above the other. As shown in FIG. 5, each passage 28 narrows at the rear with a central tapered section forming ramp surfaces 32 for capturing and aligning the ends of the LED leads 42 when these leads are inserted into the passages 28 from the front or mating face 18 of the nonconductive housing 16. The four internal passages 28 located one above another in a column all intersect a single channel 34 at the rear ends of each internal passage 28. As shown in FIG. 5, the passages 28 extend progressively further into the housing 16 with the shorter passage 28 being located at the bottom adjacent to the mounting face 22. In the preferred embodiment a single channel 34 merges or intersects four passages 28. Each channel 34 can be formed by a single core pin when the housing 16 is molded.

As shown in FIG. 5, each LED 38 has two leads 42, a longer anode lead 42' and a shorter cathode lead 42"" The longer lead 42' is positioned at the top and the shorter lead 42" when mounted in the respective internal passage so that the rear ends of the two corresponding leads are staggered, thus providing room for contacts 44 located in channel 34 to contact the appropriate lead 42 without contacting the other lead for a single LED. The leads 42 for the other LED's 38 stacked in a single column are progressively longer with the shortest cathode lead 42" being located at the bottom of the connector 2 adjacent to the mounting face 22 and the longest anode lead 42' is located at the top of the connector 2. The rear ends of the LED leads 42 are therefore staggered. The staggered leads 42 can be fabricated by cutting the leads on a single LED size to length. Different standard LED's can also be used since for standard LED's, the cathodes are shorter than the anodes. Commonly the LED anode lead is 27 mm and the cathode lead is 25.5 mm. Standard LED's with progressively longer leads can be employed so that the leads are staggered. Although anode leads are positioned above cathode leads in the preferred embodiment, this orientation can be reversed when the leads are cut to length.

Insulation displacement contacts 44 are positioned in channel 34. These contacts 44 each have an insulation displacement or split beam contact section including a slot 48 located at the top. This slot 48 has a width and depth chosen to engage the ends of the corresponding lead 42 which the individual contact intersects. The contacts 44 are stamped and formed from a resilient metal, such as phos bronze, that is suitable for establishing insulation displacement contacts. Each flat contact 44 also has a solder tail 46 at its lower end with solder tails on adjacent contacts 44 staggered to provide additional spacing when the contacts 44 are soldered in printed circuit board through holes leading to traces 54 on printed circuit board 54. The contacts 44 are positioned one behind each other in a row. Two adjacent contacts will terminate the anode and cathode lead of a single LED 38. An anode contact 44' terminated to a anode lead 42' of one LED 38 will be longer than the cathode contact 44" terminated to a corresponding cathode lead 42" of the same LED. Adjacent pairs of contacts 44 will also be progressively shorter proceeding from the top rear to the bottom front as seen in FIG. 5. The electrical termination of leads 42 in insulation displacement slots 48 are therefore staggered, providing access, from below, for each contact 44 to the corresponding LED lead 42. Each channel includes grooves 36 along opposite channel walls. The edges of the contacts 44 fit within these grooves 36 and the contacts 44 are supported in channels 34.

The stacked electrical connector 2 is assembled by first inserting the terminals 10, insert molded in body 14, into the molded nonconductive housing 16. The contacts 44 are then inserted into the channels 34, from below, into a preloaded configuration in which the insulation displacement slots 48 at the top of the contacts 44 are recessed relative to the top of the channels 34 and spaced from the location at which the leads 42 will be inserted. This preloaded position is shown in FIG. 6. With the contacts 44 in this preloaded position, the LED's 38 are fully inserted, from the front or mating face, into the corresponding passages 28 until the ends of the leads are positioned above the contact slots 48 of corresponding contacts 44. As shown in FIG. 6, the ends of leads 42 will be positioned along a support rib 30 located at the rear of the passage 28 and the top of the channel 34. This support rib 30 is narrower than the width of the slot 48 and the LED lead 42 and is molded and formed by a recess on the core pin that forms the channel 34. With the leads 42 properly positioned, the contacts 44 are pushed further into the channels 34 into their final positions so that the leads 42 are inserted into the corresponding slot 48 at the top of the respective contact 44. The insulation displacement contact formed with the LED leads 42 not only establishes an electrical termination between the leads 42, but also mechanically retain the LED's in the LED cavities 26 without the need to apply an adhesive to the LED body 40. The connector 2 can then be mounted on a printed circuit board 52. The rear ends 12 of the terminals 8 extend beyond the housing mounting face 22 as do the solder tails 46 on the ends of the contacts 44. Mounting posts 24 on the bottom of the housing 16 are then used to secure the connector 2 to the printed circuit board and the terminals 8 and contacts 44 can be soldered to pads surrounding the printed circuit board holes or to plated through holes in the printed circuit board.

The stacked connector 2 is representative of the connectors with which this invention can be employed, but the invention is not limited to use with stacked modular jacks. For example, this invention can be used with otherwise conventional pin headers soldered to printed circuit boards. This invention can also be used with surface mount connectors and the solder tails on the contacts can also be surface mount solder tails. The invention is also not limited to use with insulation displacement slots for terminating LED leads, and the leads could even be soldered to the contacts. An example of another mechanical termination would be a poke in contact employed at the top of the contacts. When a poke in contact would be used, the contacts would be inserted into the housing and the leads would then be axially inserted into an opening in the terminals. A tab in the contact opening would engage the LED lead, electrically terminating that lead. Other equivalent versions of this invention would include a connector in which the channels are inserted from the top of the connector housing with the longer LED leads being located at the bottom of the assembly. The LED's could also be inserted with the anode and cathode leads both located side by side in a horizontal plane. Each lead for the same LED could then be the same length and the corresponding contacts could then be the same length with the lead terminations being side by side. Furthermore, this invention is not limited to the use of LED's as the indicators mounted on the housing. Other status indicators or sensors could also be mounted in this manner. Therefore the scope of this invention is defined by the following claims and is not limited to the representative embodiment depicted herein.

We claim:

1. An electrical connector which is matable with a compatible connector, the electrical connector comprising:

a plurality of terminals positioned in a nonconductive housing, the housing having a mating face configured to mate with the compatible connector, an indicator located on the mating face, a passage extending rearwardly from the mating face, indicator leads extending from the indicator through the passage, the housing having a mounting face and channel means which open through the mounting face, the channel means extending in a direction transverse to the passage and intersecting the passage, contacts positioned in the channel means and extending to the mounting face, each of the contacts being electrically terminated to one of the indicator leads, each of the contacts having a split beam contact section including a slot which is open in the transverse direction whereby, during insertion of the contacts into the channel means in the transverse direction, the indicator leads which are disposed in the passage are received in the slots of the split beam contact sections and are electrically terminated to the contacts.

2. The electrical connector of claim 1 wherein the mating face extends at a right angle relative to the mounting face with the internal passage extending parallel to the mounting face and the channel means extending parallel to the mating face.

3. The electrical connector of claim 1 wherein the indicator comprises a light emitting diode.

4. The electrical connector of claim 1 wherein a plurality of said indicators are positioned in a column on the mating face.

5. The electrical connector of claim 4 wherein the length of the indicator leads is progressively less for leads closer to the housing mating face.

6. A stacked electrical connector comprising;

multiple female electrical connectors located in a nonconductive housing, each said female electrical connector having a mating opening on a mating face of the nonconductive housing for receiving a corresponding male electrical connector therein;

indicators positioned adjacent to respective ones of the mating openings, each of the indicators having leads extending through a respective passage in the nonconductive housing, each said passage penetrating the housing from the mating face;

channel means penetrating the nonconductive housing from a second face of the nonconductive housing and intersecting each said passage; and contacts located in the channel means and forming an electrical connection with the indicator leads at the intersections of the passages and the channel means, wherein the intersections between the indicator leads and the contacts are staggered, and the contacts extend to the second face of the nonconductive housing for external electrical termination.

7. The stacked electrical connector of claim 6 wherein the contacts have different lengths and the leads have different lengths.

8. The stacked electrical connector of claim 7 wherein longer leads are connected to longer contacts and shorter leads are connected to shorter contacts.

9. The stacked electrical connector of claim 6 wherein the channel means extend upwardly from a mounting face extending perpendicular to the mating face.

10. A printed circuit board jack matable with a plug, the jack comprising:

a plurality of terminals positioned within a nonconductive housing, each said terminal having a mating end located adjacent to a mating face of the housing, the housing including a passage extending from the mating face and a channel intersecting the passage and opening on a printed circuit board face of the housing;

an indicator positioned on the mating face, the indicator having two indicator leads extending through the passage, the leads intersecting the channel, one of the leads being shorter than the other of the leads; and printed circuit board contacts extending through the channel and contacting the indicator leads at the intersection of the passage and the channel so that the indicator leads can be connected to printed circuit board traces, wherein the contact which is connected to the shorter lead is positioned in front of the contact which is connected to the relatively longer lead.

11. The jack of claim 10 wherein the passage and the channel extend beside the terminals.

12. The jack of claim 11 wherein the terminals are right angle terminals with the passage and the channel intersect at right angles.

13. The jack of claim 12 wherein each indicator includes an anode lead and a cathode lead and the jack includes two contacts for each indicator, a first contact engaging the anode lead and a second contact engaging the cathode lead.

14. The jack of claim 10 wherein each said contact includes a split beam contact section at the top thereof, and the indicator leads are positioned in respective ones of the split beam contact sections.

15. The jack of claim 10 wherein the indicator is a light emitting diode.

16. The jack of claim 10 comprising a multiposition jack having a plurality of separate mating openings on the mating face for receiving multiple plugs, separate indicators being positioned adjacent each mating opening.

17. The jack of claim 10 comprising an RJ-45 jack.

18. The jack of claim 10 wherein a plurality of indicators are positioned on the mating face, one passage extending from the mating face for each indicator with a single channel intersecting passages for multiple indicators.

19. The jack of claim 10 wherein the contact connected to the shorter lead is shorter than the contact connected to the relatively longer lead.

20. The jack of claim 19 comprising a stacked modular jack with at least two jacks being positioned one above the other in the same nonconductive housing, and the indicators adjacent to the jacks are also positioned one above the other.

* * * * *